US010242601B2

(12) United States Patent
Maltas et al.

(10) Patent No.: US 10,242,601 B2
(45) Date of Patent: Mar. 26, 2019

(54) LABEL ASSEMBLY WITH ADHESIVE CLOSURE FOR ELASTOMER LOOP

(71) Applicant: Bedford Industries, Inc., Worthington, MN (US)

(72) Inventors: Jeffrey S. Maltas, Sibley, IA (US); Trevor Wintz, Round Lake, MN (US); David Schiller, Sioux Falls, SD (US); Colin M. O'Donnell, Worthington, MN (US)

(73) Assignee: Bedford Industries, Inc., Worthington, MN (US)

( * ) Notice: Subject to any disclaimer, the term of this patent is extended or adjusted under 35 U.S.C. 154(b) by 28 days.

(21) Appl. No.: 15/100,018

(22) PCT Filed: Dec. 2, 2014

(86) PCT No.: PCT/US2014/068122

§ 371 (c)(1),
(2) Date: May 27, 2016

(87) PCT Pub. No.: WO2015/084823

PCT Pub. Date: Jun. 11, 2015

(65) Prior Publication Data

US 2017/0004741 A1 Jan. 5, 2017

Related U.S. Application Data

(60) Provisional application No. 61/911,063, filed on Dec. 3, 2013.

(51) Int. Cl.
*G09F 3/14* (2006.01)
*G09F 3/10* (2006.01)
(Continued)

(52) U.S. Cl.
CPC ..... *G09F 3/10* (2013.01); *G09F 3/0295* (2013.01); *G09F 3/03* (2013.01); *G09F 3/14* (2013.01);
(Continued)

(58) Field of Classification Search
USPC ..... 40/625
See application file for complete search history.

(56) References Cited

U.S. PATENT DOCUMENTS 4,817,310 A * 4/1989 Breen ..... A45C 13/42 40/6
5,490,658 A 2/1996 Coward et al.
(Continued)

FOREIGN PATENT DOCUMENTS

EP 1734494 A1 12/2006
FR 3010601 A1 * 3/2015 ..... H04B 1/385
(Continued)

OTHER PUBLICATIONS

International Search Report and Written Opinion dated Jun. 15, 2015 for corresponding International Application No. PCT/US2014/068122, filed Dec. 2, 2014.
(Continued)

*Primary Examiner* — Joanne Silbermann
(74) *Attorney, Agent, or Firm* — Mai-Tram D. Lauer; Westman, Champlin & Koehler, P.A.

(57) ABSTRACT

A label assembly that includes an elastic band having a first end, a second end, and a bridging segment between the first end and the second end, and that also includes an adhesive anchor bonded to the second end of the elastic band. In some embodiments, the label assembly also includes a tag portion bonded to the first end, where the adhesive anchor is configured to adhere to the tag portion to form the elastic band into a loop. In some other embodiments, the label
(Continued)

assembly includes a second adhesive anchor bonded to the second end of the elastic band.

19 Claims, 8 Drawing Sheets

(51) Int. Cl.
*G09F 3/00* (2006.01)
*G09F 3/20* (2006.01)
*G09F 3/03* (2006.01)
*G09F 3/02* (2006.01)

(52) U.S. Cl.
CPC ..... *G09F 3/205* (2013.01); *G09F 3/206* (2013.01); *G09F 2003/0254* (2013.01); *G09F 2003/0273* (2013.01)

(56) References Cited

U.S. PATENT DOCUMENTS 5,560,657 A * 10/1996 Morgan ..... G09F 3/0292 283/80
5,733,652 A 3/1998 Stowman et al.
6,490,821 B1 12/2002 Lacek
6,497,063 B1 12/2002 Stephens
7,386,949 B2 * 6/2008 Riley ..... B42D 15/00 283/75
7,763,135 B1 7/2010 Maltas et al.
7,866,072 B2 * 1/2011 Diliscia ..... G09F 3/00 40/304
7,941,953 B2 5/2011 Ludlow et al.
2010/0013211 A1 1/2010 Ahmed
2012/0153109 A1 6/2012 Milbrandt
2012/0198738 A1 * 8/2012 Olivarez ..... G09F 3/0295 40/316
2013/0239449 A1 9/2013 Heinrichs
2016/0225292 A1 * 8/2016 Maltas ..... G09F 3/04

FOREIGN PATENT DOCUMENTS

JP 2003043919 A 2/2003
JP 2008150080 A 7/2008
NL 1016806 B 8/2002

OTHER PUBLICATIONS

Communication pursuant to Rules 161(1) and 162 EPC in related European Patent Application No. 14815545.0-1801 dated Jul. 12, 2016.
European Office Action dated Jun. 6, 2017 for European Application No. 14815545.0.
Australian Examination Report No. 1 dated Jul. 12, 2018 for Australian patent application No. 2014360724.

* cited by examiner

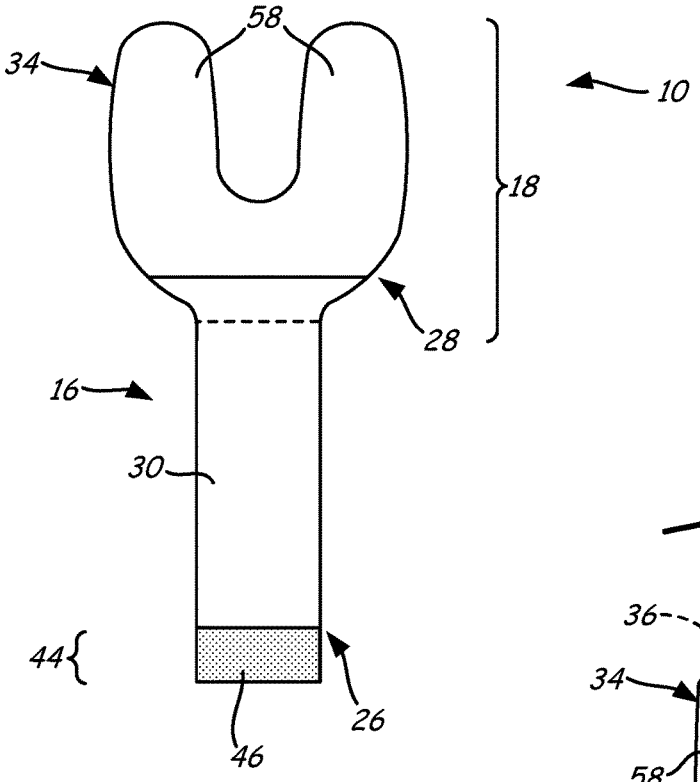
FIG. 8
FIG. 9
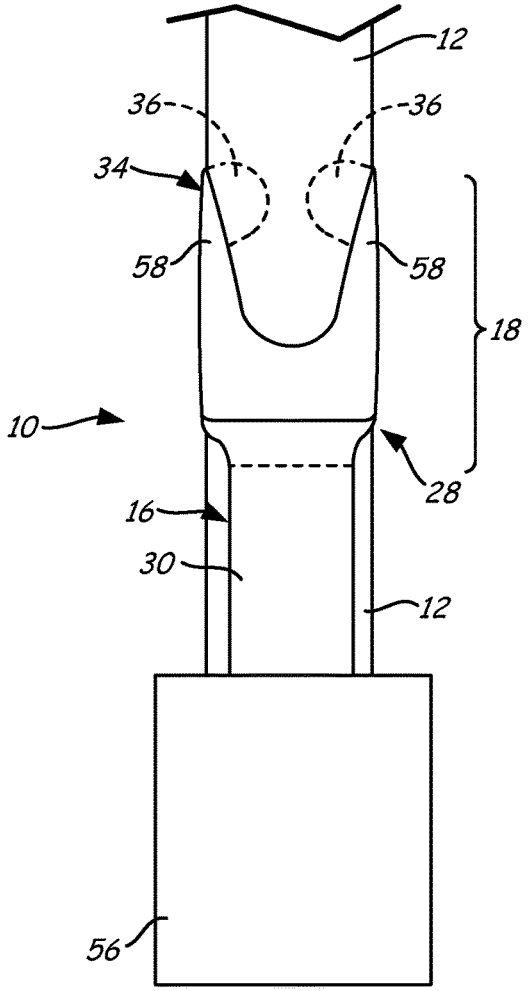

LABEL ASSEMBLY WITH ADHESIVE CLOSURE FOR ELASTOMER LOOP

CROSS-REFERENCE TO RELATED APPLICATION

This Application is a Section 371 National Stage Application of International Application No. PCT/US2014/068122, filed Dec. 2, 2014 and published as WO/2015/084823 on Jun. 11, 2015, which claims priority to U.S. Provisional Patent Application No. 61/911,063, filed Dec. 3, 2013, the contents of which are hereby incorporated by reference in their entirety.

BACKGROUND

The present disclosure relates to labels for use with various articles (e.g., commercial products and other items). In particular, the present disclosure relates to label assemblies for use with articles to display information and/or sample items, and methods of use thereof.

It is known to use an elastic material to affix a label or tag to an item such as a product package, bottle or the like. In those instances where the item being tagged has an irregular shape or if it is desired to bind several items together, the elastic material is desirably resilient enough to be placed around the item(s) (e.g., a watermelon, bunch of asparagus, large container or other item) yet maintain its labeling function without distortion to the label. In many cases, the label may include not only human detectable indicia, but also machine detectable indicia (e.g., a UPC bar code). In addition, the label and its elastic fastening component must be strong enough to stand the rigors of transport and handling, and retain itself in position on the item without damage thereto.

SUMMARY

An aspect of the present disclosure is directed to a label assembly that includes a tag portion and an elastic band, where the elastic band includes a first or proximal end bonded to the tag portion, a second or distal end. and a bridging segment between the first and second ends. The label assembly also includes an adhesive anchor bonded to the second end of the elastic band, and configured to adhere to the tag portion to form the elastic band into a loop.

Another aspect of the present disclosure is directed to a label assembly that includes an elastic band having a first or proximal end bonded to the tag portion, a second or distal end, and a bridging segment between the first and second ends. The label assembly also includes a first adhesive anchor bonded to the first end of the elastic band, and configured to adhere to an article, and a second adhesive anchor bonded to the second end of the elastic band, and configured to adhere to a separate item to suspend the sample item from the article.

Another aspect of the present disclosure is directed to a method of using a label assembly. The method includes providing the label assembly having a tag portion, an elastic band, and an adhesive anchor, where the elastic band bridges the tag portion and the adhesive anchor. The method also includes wrapping the elastic band around an article, and adhering the adhesive anchor to the tag portion to provide the wrapped elastic band as a loop around the article.

DEFINITIONS

Unless otherwise specified, the following terms as used herein have the meanings provided below:

The terms "least one" and "one or more of" an element are used interchangeably, and have the same meaning that includes a single element and a plurality of the elements, and may also be represented by the suffix "(s)" at the end of the element. For example, "least one article", "one or more articles", and "article(s)" may be used interchangeably and have the same meaning.

The terms "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the present disclosure.

The terms "about" and "substantially" are used herein with respect to measurable values and ranges due to expected variations known to those skilled in the art (e.g., limitations and variabilities in measurements).

BRIEF DESCRIPTION OF THE DRAWINGS

The disclosed subject matter will be further explained with reference to the attached figures, wherein like structure is referred to by like reference numerals throughout the several views. In the shown side illustrations, separate layers are distinguished by hatching for ease of visibility.

FIG. 8 is a front illustration of the fifth alternative label assembly of FIG. 7.

FIG. 9 is a front illustration of the fifth alternative label assembly of FIG. 7 secured to an article and in use with a separate sample item.

Although the above-identified figures set forth various features of the disclosed subject matter, other combinations of features are also contemplated, as noted in the disclosure. In all cases, this disclosure presents the disclosed subject matter by way of representation and not limitation. It should be understood that numerous other modifications and feature combinations can be devised by those skilled in the art which fall within the scope and spirit of the principles of this disclosure. It should be understood that the figures have not been drawn to scale as it has been necessary to enlarge certain portions for clarity of illustration.

DETAILED DESCRIPTION

In a first aspect, the present disclosure is directed to a label assembly having a tag portion and an elastic band, where the elastic band is configured to be looped around an article (e.g., a commercial product or other item) and adhered to a rear side of the tag portion. As discussed below, in other aspects, the tag portion may be omitted and the label assembly may be used for a variety of alternative purposes, such as for suspending separate sample items from articles.

Figure 1A:
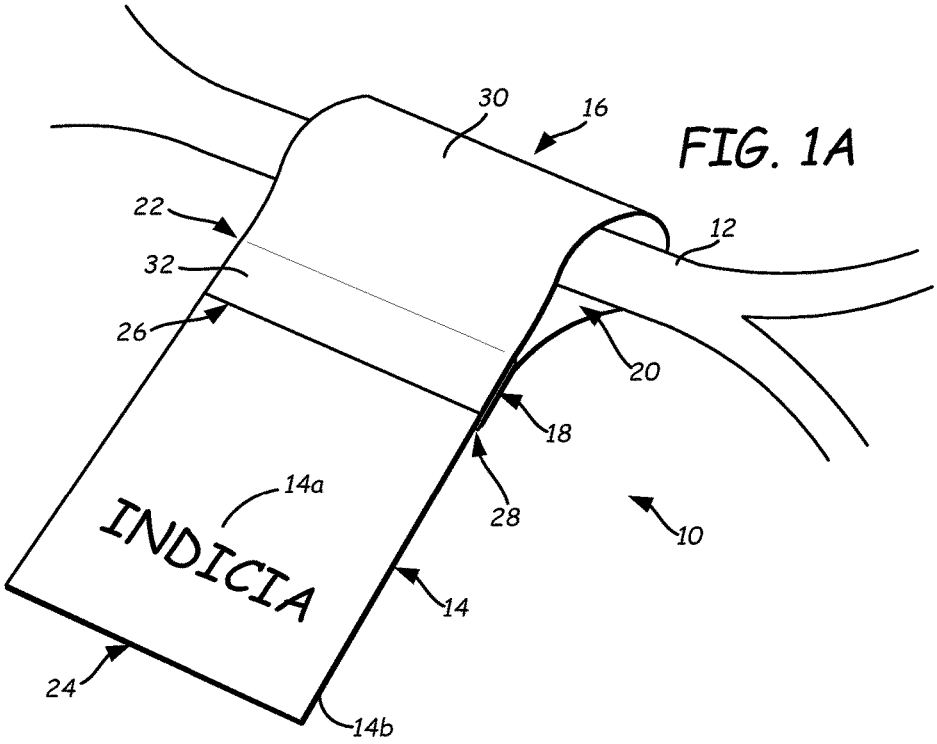
FIG. 1A is a front perspective view of a label assembly of the present disclosure secured around an article, which includes an elastic band and a tag portion, where the elastic band is formed into a loose-fit loop.
Figure 1B:
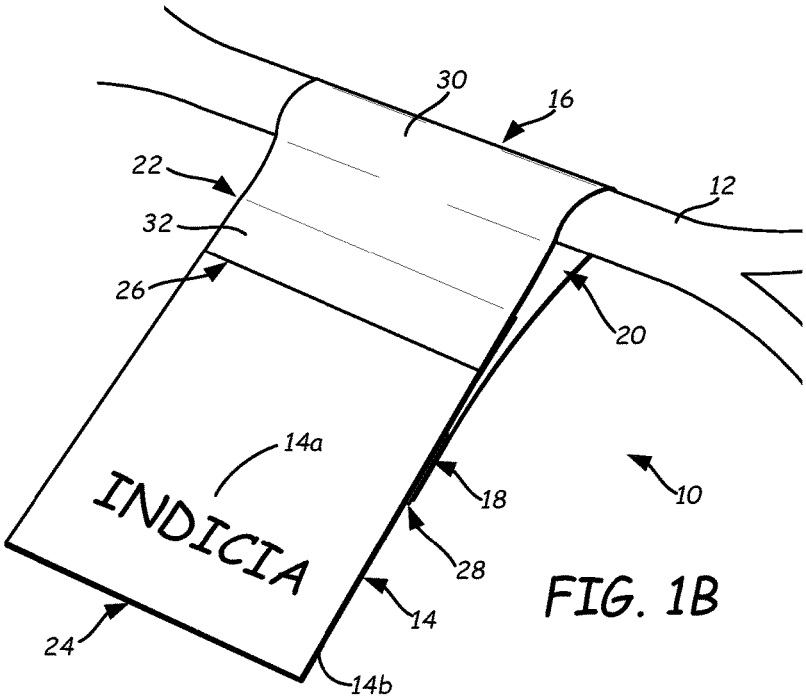
FIG. 1B is a front perspective view of the label assembly of FIG. 1A secured around the article, where the elastic band is formed into a tighter loop

FIGS. 1A and 1B illustrate label assembly 10 secured around article 12, where article 12 is an example article that label assembly 10 may be used with, such as, for example, a live plant stem or twig. However, label assembly 10 may be used with a variety of different articles, such as commercial products and other items. Additionally, label assembly 10 may be secured around a bundle of multiple articles, such as bundles of agricultural produce, writing utensils, and the like.

As can be appreciated, many articles are less suitable for use with labeling tags having expandable loops, as such as those disclosed in Ludlow et al., U.S. Pat. No. 7,941,953. For instance, an elongated article 12 having enclosed ends may prevent an expandable loop from being slid onto the elongated article 12. A good example of this scenario is a ladder rung, which is enclosed between a pair of side legs. In this case, an expandable loop cannot be slid around the ladder rung due to interference by the side legs.

In comparison, as shown in FIGS. 1A and 1B, label assembly 10 may be uniquely secured around any suitable article 12, despite the ends of the article 12 being blocked. In particular, label assembly 10 includes tag portion 14 (having front surface 14*a* and rear surface 14*b*), elastic band 16, and adhesive anchor 18, where elastic band 16 is looped around article 12 and adhered to rear surface 14*b* with adhesive anchor 18, thereby forming loop 20. This secures label assembly 10 to article 12 in a manner that prominently displays front surface 14*a* (and/or rear surface 14*b*) of tag portion 14.

As further shown, loop 20 may be sized large enough to provide a loose fit around the article(s). In this case, as shown in FIG. 1A, adhesive anchor 18 of elastic band 16 may be secured to rear surface 14*b* in the region of a top end 22 of tag portion 14, where tag portion 14 may include top end 22 and an opposing bottom end 24. Securing adhesive anchor 18 in the region of top end 22 provides a larger size for loop 20, thereby providing the loose fit around article 12 (depending on the dimensions of article 12).

Alternatively, as shown in FIG. 1B, the size of loop 20 may be reduced by securing adhesive anchor 18 at another region along rear surface 14*b*, downward from top end 22 and closer to bottom end 24. Depending on the dimensions of article 12, this can potentially provide a snug fit around article 12, or otherwise reduce the looseness of loop 20. For ease of discussion, the following disclosure focuses primarily on the use of label assembly 10 with a single article (e.g., article 12). However, as mentioned above, it is understood that label assembly 10 may also be secured around a bundle of multiple articles in the same manner.

Front surface 14*a* of tag portion 14 may include printed indicia, such as textual indicia, illustrative indicia, machine-readable indicia, and the like. For instance, display surface 14*a* may include product-related information for article 12, such as a brand logo, UPC code, safety and use instructions, and the like. If desired, the rear surface 14*b* may also include printed indicia.

Tag portion 14 may be produced from any suitable printable material, such as paper-based and/or polymeric materials, and may be a single-layer or multiple-layer tag. For the printed indicia, any suitable ink or other printing composition compatible or accepted on tag portion 14, in any desired color(s), may be used.

In some embodiments, tag portion 14 is produced from one or more paper-based materials suitable for receiving printed indicia. Many paper-based materials are known for their compatibility with printing inks. However, the material for tag portion 14 is also preferably water resistant so as to not degrade or otherwise deform when exposed to water, and is also preferably tough enough to be sufficiently tear resistant to deter damage to it from customer handling.

In addition, the printed indicia, particularly any printed machine-readable information (e.g., a bar code), should be sufficiently water resistant to avoid degradation when repeatedly subjected to water and washing operations (e.g., as is common for plant display at nurseries or produce displays in supermarkets). Accordingly, tag portion 14 produced from one or more paper-based materials may also include one or more polymeric layers configured to protect and reinforce the paper-based materials, and to protect any printed indicia. For example, display surface 14*a* of tag portion 14 may include a thin film of water-insoluble, transparent plastic disposed over the indicia to enhance water and wear resistance.

Alternatively, tag portion 14 may be produced from one or more polymeric materials that may receive printed indicia, and may be opaque, translucent, or transparent, as individual needs may require. Suitable polymers for tag portion 14 include polystyrenic thermoplastics, polyolefinic thermoplastics (e.g., polyethylene and polypropylene), polyesters, copolymers thereof, blends thereof, and the like.

The polymeric material(s) may be formulated so that printing inks are readily accepted on display surface 14*a*, and/or treated with special surface treatments to effect acceptance of printing inks. The surface treatment may enhance wettability and adhesion characteristics of tag portion 14 to printing inks. The polymeric material(s) of tag portion 14 may also optionally include one or more compatible additives to achieve coloration, opacification, resistance to degradation on exposure to some environments, improved impact properties, improved adhesion properties, and the like.

Additionally, the material(s) for tag portion 14 are preferably non-elastic, such that tag portion 14 itself is substantially non-stretchable. This prevents the printed indicia on display surface 14*a* from being distorted by the stretching. It cannot be emphasized enough that, in situations where reliable machine-readable information (e.g., UPC codes) is critical, tag portion 14 should be sufficiently non-elastic to avoid the risk of unscannable distortion for the machine-readable information.

In the shown example, tag portion 14 is provided as a sheet or film-like member. However, tag portion 14 may alternatively have any suitable dimensions, which may vary depending on the particular needs. For example, tag portion 14 may have dimensions and shapes that vary along its length, such as a sinusoidal pattern, widths that vary along the length, individually-tailored designs (e.g., brand logos), and the like. Moreover, tag portion 14 may include cut-out holes with individually-tailored designs, if desired, to further provide information and aesthetic characteristics. In some embodiments, tag portion 14 may be foldable and/or include a pocket, such as disclosed in Heinrichs, U.S. Publication No. 2013/0239449.

Elastic band 16 includes a proximal end 26 bonded to top end 22 of tag portion 14, and a distal end 28 opposite of proximal end 26 and bonded to adhesive anchor 18. Elastic band 16 also includes bridging segment 30 between proximal end 26 and distal end 28, where bridging segment 30 typically defines the majority of loop 20 when elastic band 16 is wrapped in a looped orientation.

Figure 2:
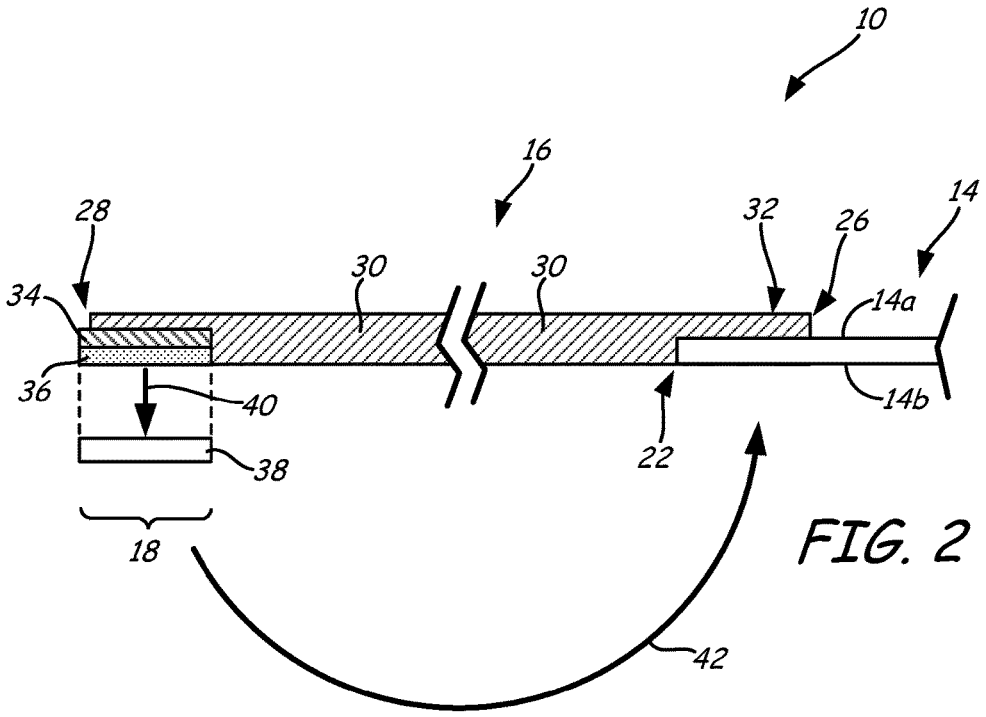
FIG. 2 is a side illustration of the label assembly of FIG. 1A in a flat, non-looped state.

Proximal end 26 of elastic band 16 is conjoined with tag portion 14 along a relatively flat bonding segment 32. In particular, as best shown in FIG. 2, flat bonding segment 28 overlaps with tag portion 12 and may be bonded (e.g., heat sealed) or otherwise secured to front surface 14*a* of tag portion 14. The overlapping region of flat bonding segment 28 and front surface 14*a* of tag portion 14 is preferably sufficient so that elastic band 16 does not separate from tag portion 14 during use.

While illustrated as having a generally rectangular geometry in the flat state, bridging segment 30 may alternatively be cut to have dimensions and shapes that vary along its length, such as a sinusoidal pattern, widths that vary along the length, individually-tailored designs (e.g., brand logos), and the like. Furthermore, bridging segment 30 may be cut to include a variety of different interior holes, such as for individually-tailored designs. Various combinations of these different embodiments may also be used to individually tailor bridging segment 30 to attain a desired elastic and/or aesthetic properties.

Elastic band 16 may be derived from one or more elastomeric materials capable of providing elastic characteristics to bridging segment 30. Suitable elastomeric materials for elastic band 16 include thermoplastic elastomers, such as styrenic block copolymers (e.g., styrene-butadiene styrene and styrene-ethylene-butylene styrene), olefinic elastomers (e.g., ethylene and polypropylene based polyvinyl chloride-based elastomers, urethanes, nylon, silicon, and the like).

The elastomeric material(s) provide elastic band 16 with sufficient elasticity such that bridging segment 30 may be stretched from a relaxed state to a stretched state, and may contract back from its stretched state to its relaxed state, if desired. Suitable average thicknesses for elastic band 16 in its relaxed state range from about 10 mils to about 50 mils, where bridging segment 30 may be thicker than the segments of elastic band 16 at proximal end 26 and distal end 28, as shown in FIG. 2. In alternative embodiments, typically depending on the manufacturing technique used, elastic band 16 may have a substantially uniform thickness across proximal end 26, distal end 28, and bridging segment 30.

At distal end 28, adhesive anchor 18 includes support layer 34, adhesive layer 36, and liner 38. Support layer 34 provides structural integrity to adhesive anchor 18, and transfers any potential stretching-based stress loads applied to adhesive anchor 18 during use. This preserves the adhesive bonds between adhesive anchor 18 and rear surface 14*b* when elastic band 16 forms loop 20. Support layer 34 is preferably produced from one or more non-elastic materials, such as paper-based materials, polymeric materials, metallic materials, and the like, such that support layer 34 is substantially non-stretchable.

Examples of suitable materials for support layer 34 include those discussed above for tag portion 14, which preferably maintain good interlayer bonds to distal end 28 of elastic band 16 and to adhesive layer 36. In some embodiments, support layer 34 may also be surface treated to increase the interlayer bonds to elastic band 16 and adhesive layers 36. Suitable average thicknesses for support layer 34 range from about 5 mils to about 20 mils.

Adhesive layer 36 may be produced from one or more adhesive materials that are suitable for securely adhering adhesive anchor 18 to rear surface 14*b* of tag portion 14. Examples of suitable adhesive materials for adhesive layer 14 include pressure sensitive adhesives (PSAs) (e.g. hot-melt PSAs), such as those based on acrylic monomers and polymers (e.g., bio-based acrylates), block copolymer rubber adhesives, silicone rubber adhesives, and the like, which may optionally include one or more additional tackifying resins. Suitable average thicknesses for adhesive layer 36 range from about 5 mils to about 30 mils. As discussed below, in some embodiments, support layer 34 and adhesive layers 36 may be provided together, such as with a label stock.

Liner 38 is a release liner or other suitable carrier web that is configured to releasably cover adhesive layers 36 prior to forming loop 20. Liner 38 may be fabricated from a paper and/or polymeric web (e.g., a polyolefin and/or polyethylene terephthalate web) coated with one or more release agents (e.g., a silicone release coating). This allows label assembly 10 to be packaged, transported, and stored prior to forming loop 20. In some embodiments, liner 38 may extend across the bottom surface of bridging segment 30, and optionally, also across rear surface 14*b* of tag portion 14, if desired. These embodiments are beneficial for manufacturing and transporting/storing multiple tag assemblies 10 in roll or sheet forms.

Examples of suitable techniques for manufacturing label assembly 10 and elastic band 16 include those disclosed in Maltas et al., U.S. Provisional Patent Application No. 61/877,798; and in co-filed U.S. Provisional Patent Application No. 61/911,065. In some preferred embodiments, the support layer 34, adhesive layer 36, and liner 38 are provided as a label stock that may undergo subsequent steps for forming adhesive anchor 18 bonded to distal end 28 of elastic band 16.

In the embodiment shown in FIG. 2, distal end 28 of elastic band 16 does not extend across the entirety of support layer 34, exposing a portion of the front surface of support layer 34. This arrangement may be beneficial for relaxing manufacturing tolerances, allowing a small amount of registration float to exist when forming elastic band 16 on support layer 34. However, in alternative embodiments, elastic band 16 may cover the entirety of support layer 34, or even past support layer 34, if desired.

During use, liner 38 may be removed from adhesive layer 36, as illustrated by arrow 40. Elastic band 16 may then be wrapped around one or more articles (e.g., article 12, shown in FIGS. 1A and 1B), as illustrated by arrow 42, to form loop 20 having a desired size (e.g., loose or snug fit). When the desired size is attained, adhesive layer 36 may be adhered to rear surface 14*b* of tag portion 14 at the appropriate location to maintain the desired size for loop 20. This secures distal end 28 of elastic band 16 to tag portion 14 to maintain elastic band 16 as loop 20 around the article(s), allowing tag portion 14 to display information (e.g., indicia) in a prominent manner.

An interesting aspect of label assembly 10 is the fact that support layer 34 stiffens adhesive layer 36 in the layer-wise plane that is parallel to a stretching direction of loop 20. This stiffening prevents adhesive layer 36 from stretching under stress loads applied to elastic band 16, such as when loop 20 is small to provide a snug fit around one or more articles. In effect, this causes adhesive layer 36 to be substantially non-elastic (i.e., substantially non-stretchable), without requiring the use of non-elastic materials in adhesive layer 36 that could otherwise dilute the adhesive properties.

Figure 3:
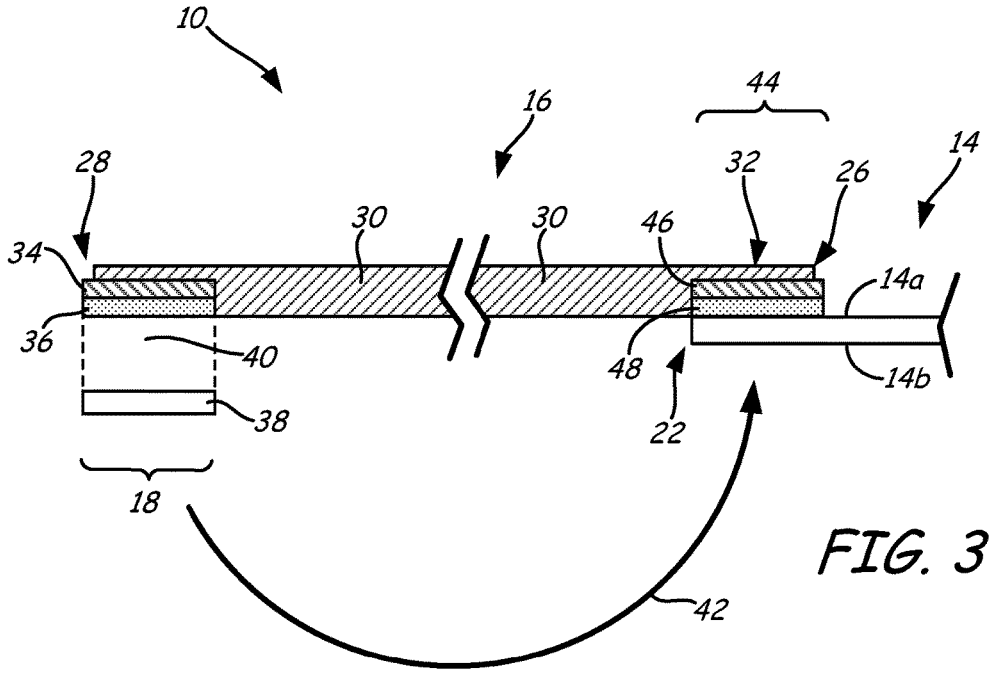
FIG. 3 is a side illustration of a first alternative label assembly, where the tag portion is adhered to the elastic band with an adhesive layer.

FIG. 3 illustrates alternative label assembly 10, which includes a second adhesive anchor 44 having support layer 46 and adhesive layer 48. Suitable materials and details for support layer 46 and adhesive layer 48 include those discussed above for support layer 34 and adhesive layer 36. In this embodiment, front surface 14*a* of tag portion 14 may be adhered to proximal end 26 of elastic band 16 with adhesive layer 48 to secure top end 22 of tag portion 14 to elastic band 16.

Figure 4:
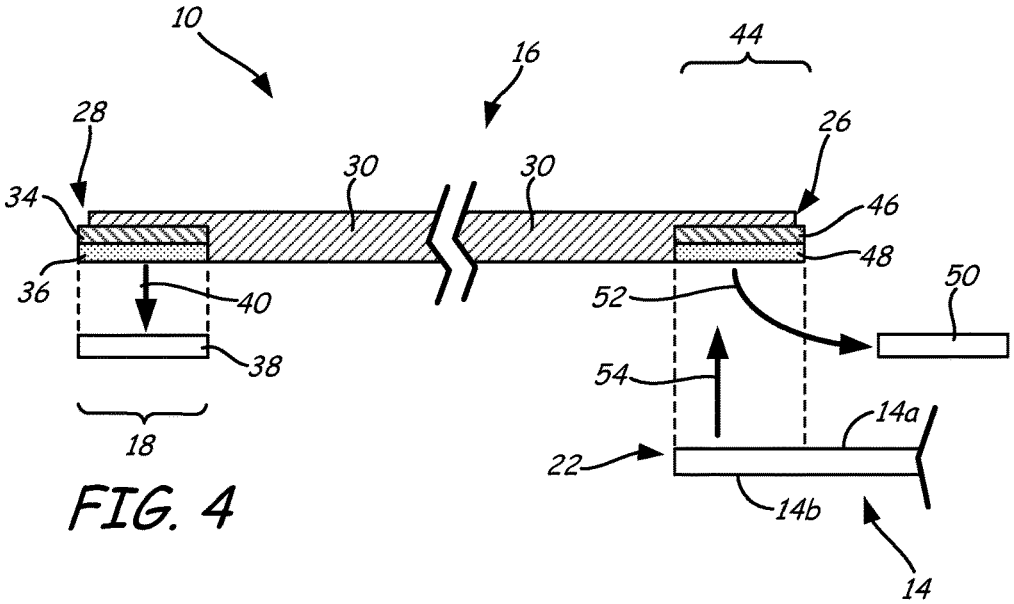
FIG. 4 is a side illustration a second alternative label assembly, where the tag portion is separate and adherable to the elastic band.

As shown in FIG. 4, in a further alternative embodiment, tag portion 14 may be separate from elastic band 16, where second adhesive anchor 44 may also include liner 50, which may function in the same manner as discussed above for liner 38. In this embodiment, elastic band 14 may be generically used with a variety of different and separate tag portions 14. During use, liner 50 may be removed, as illustrated by arrow 52, and front surface 14*a* (or rear surface 14*b*) of tag portion 14 may be adhered to adhesive layer 48 at any desired location across tag portion 14, as illustrated by arrow 54. Elastic band 16 may then be formed into loop 20, as discussed above.

Figure 5:
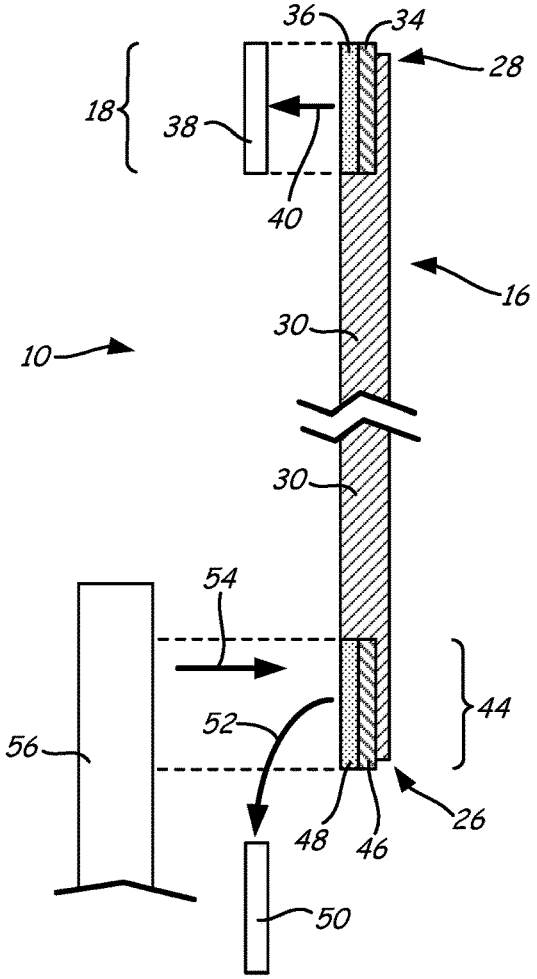
FIG. 5 is a side illustration of a third alternative label assembly, which is adherable to an article, and to configured to retain a separate sample item.

FIG. 5 illustrates yet another useful embodiment for elastic band 16. In this embodiment, tag portion 14 may be replaced with a separate item, such as a separate sample item 56, allowing elastic band 16 to suspend sample item 56 from an article. For instance, during use, liner 38 may be removed and adhesive layer 36 may be adhered to a primary article (e.g., a product, not shown). Liner 50 may also be removed and adhesive layer 48 may be adhered to sample item 56. This allows sample items, such as samples of a related product that the producer may wish a consumer to try in combination with the primary article adhered to adhesive layer 36.

Figure 6:
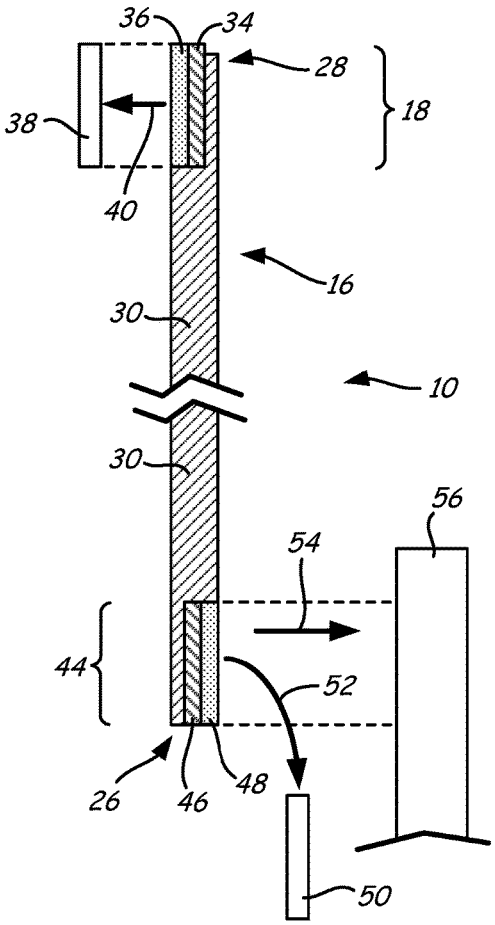
FIG. 6 is a side illustration of a fourth alternative label assembly, which is adherable to an article, and configured to retain a separate sample item on an opposing side of the elastic band.

FIG. 6 illustrates an alternative arrangement to the embodiment shown in FIG. 5, where support layer 46 and adhesive layer 48 of adhesive anchor 44 are oriented on the front side of elastic band 16. This allows adhesive anchor 44 and proximal end 26 of elastic band 16 to remain hidden behind sample item 56 when secured to together and suspended from the primary article.

Figure 7:
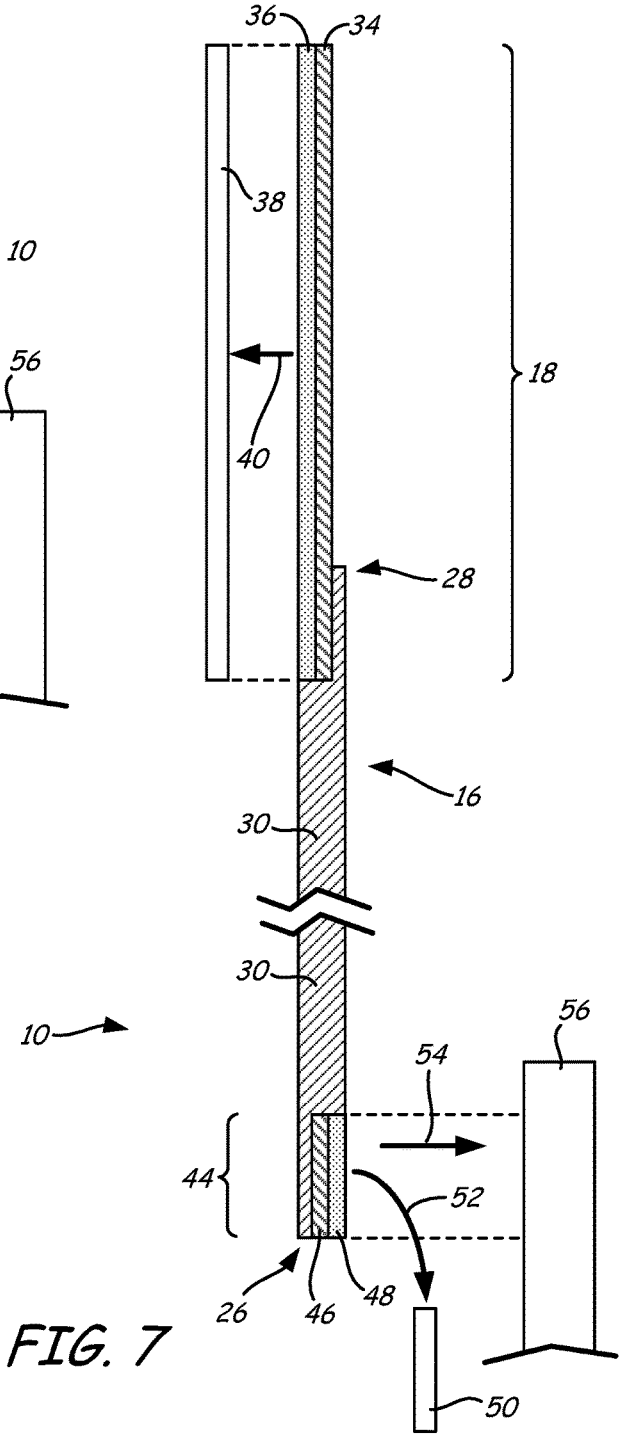
FIG. 7 is a side illustration of a fifth alternative label assembly, which is adherable to an article with an extended and shaped adhesive layer.

FIGS. 7-9 illustrate yet another arrangement this is similar to the opposing-sided embodiment shown in FIG. 6. In this embodiment, however, adhesive anchor 18 is larger in size, and may be shaped accommodate irregular adhesion surfaces. For instance, as shown in FIGS. 8 and 9, support layer 34 and adhesive layer 36 may be shaped with finger members 58, which may wrap around an irregularly-shaped article 12 (shown in FIG. 9) to securely adhere elastic band 16 to the article 12.

Accordingly, adhesive anchor 18 may be shaped to be accommodate a variety of different articles, such as bottle handles, pipes, and the like, while also prominently displaying sample item 56. Furthermore, the wrap-around characteristics of finger members 58 allow adhesive layer 36 to be adhered around bundles of multiple articles, such as bundles of utensils, to hold the bundle together.

Figure 10:
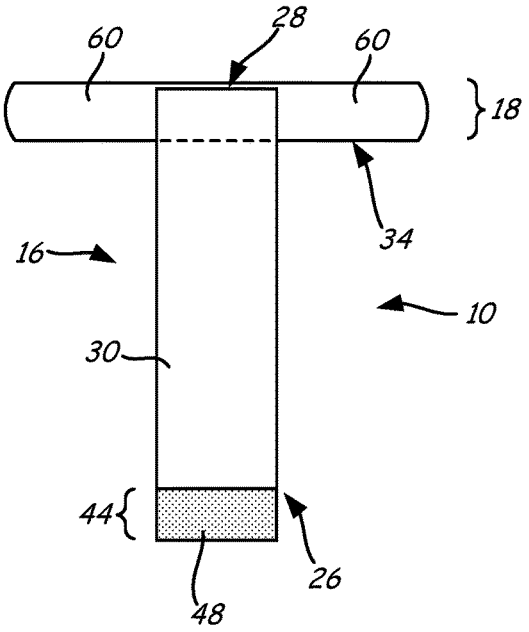
FIG. 10 is a front illustration of a sixth alternative label assembly, which is configured to function as a tamper-resistant seal for an article, and to retain a separate sample item.
Figure 11:
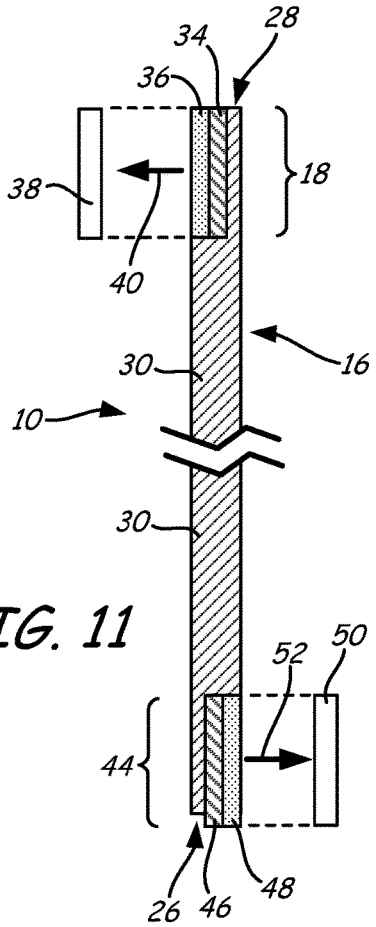
FIG. 11 is a side illustration of the sixth alternative label assembly of FIG. 10.
Figure 12:
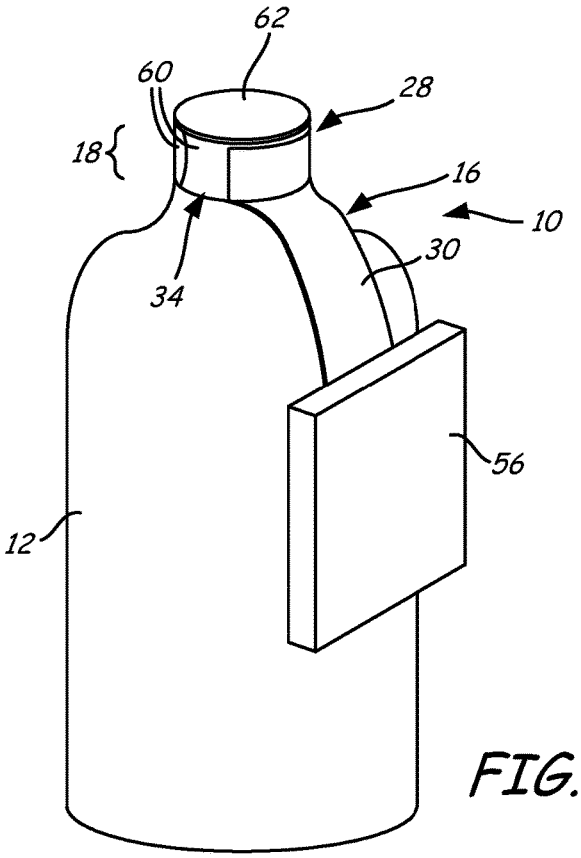
FIG. 12 is a front perspective illustration of the sixth alternative label assembly of FIG. 10 secured to an article and in use with a separate sample item.

FIGS. 10-12 illustrate an embodiment in which adhesive anchor 18 may function as a tamper-resistant seal for articles (e.g., bottle lid seals), while adhesive anchor 44 may retain a sample item 56. In particular, as shown in FIG. 10, adhesive anchor 18 may include arm members 60 extending substantially perpendicular to the length of elastic band 16, such that support layer 34 and adhesive layer 36 may form a sealable band. For example, as shown in FIG. 12, arm members 60 may wrap around a bottle lid 62 of article 12 to form a tamper-resistant seal such that bottle lid 62 may not be removed without breaking the seal. This arrangement also allows sample item 56 (or some other article attached to elastic band 16, such as, for example, tag portion 14) to be suspended from article 12 for display.

Figure 13:
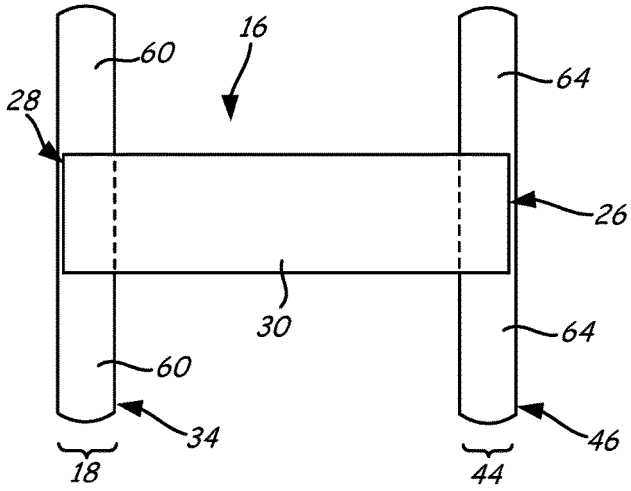
FIG. 13 is a front illustration of a seventh alternative label assembly, which is configured to function as a tamper-resistant seal for a pair of articles.
Figure 14:
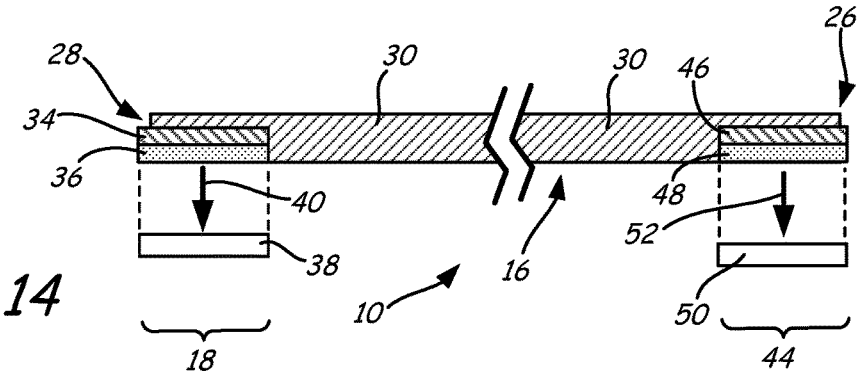
FIG. 14 is a side illustration of the seventh alternative label assembly of FIG. 13.
Figure 15:
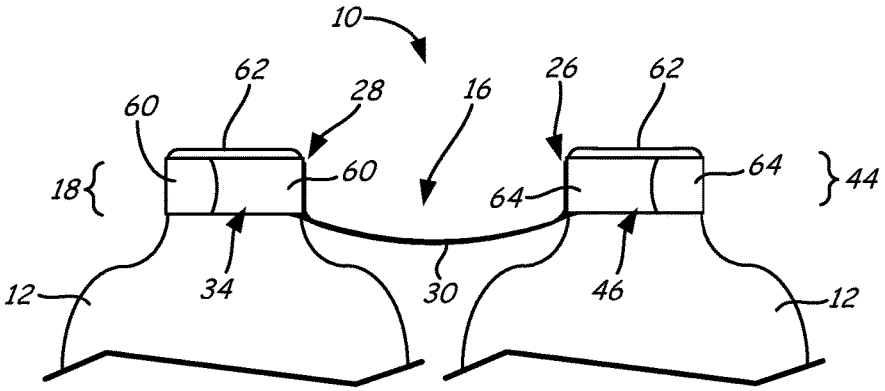
FIG. 15 is a front illustration of the seventh alternative label assembly of FIG. 13 secured to a pair of articles.

FIGS. 13-15 illustrate an alternative to the embodiment shown in FIGS. 10-12, where adhesive anchor 44 includes arm members 64 to also function as a tamper-resistant seal for articles (e.g., bottle lid seals). As shown in FIG. 15, this arrangement allows a pair of articles 12 to be sealed with adhesive anchors 18 and 44, and to be elastically connected by elastic band 16.

Figure 16:
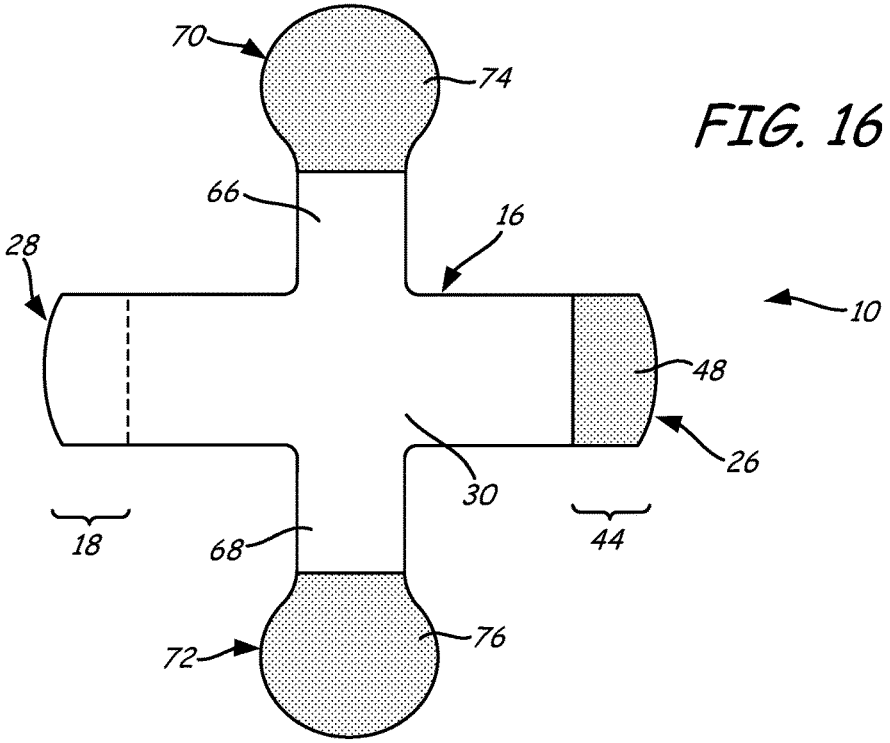
FIG. 16 is a front illustration of an eighth alternative label assembly, which includes additional adhesive layers for retaining a separate sample item.
Figure 17:
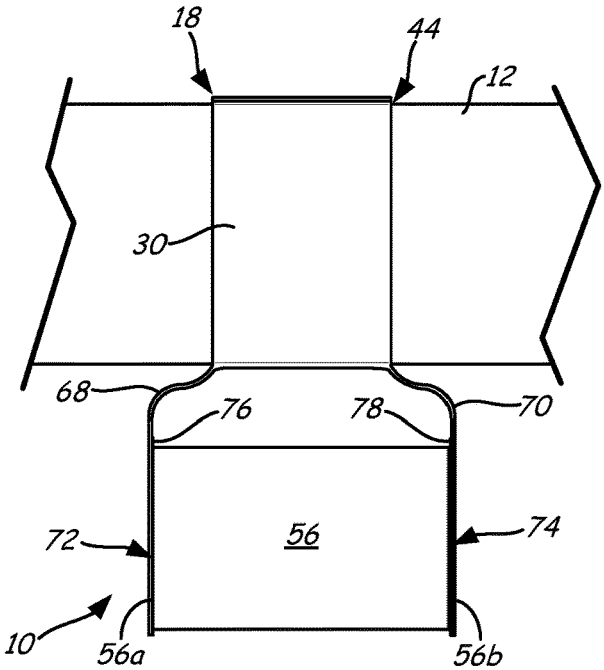
FIG. 17 is a front view of the eighth alternative label assembly of FIG. 16 in use with an article and a separate sample item.

As shown in FIGS. 16 and 17, in another embodiment, elastic band 16 may include additional segments 66 and 68, which respectively terminate in additional adhesive anchors 70 and 72. Adhesive anchors 70 and 72 may each correspondingly include a support layer (not shown), an adhesive layer (referred to as adhesive layers 74 and 76), and a liner (not shown).

As shown in FIG. 17, in this embodiment, elastic band 16 may be wrapped around article 12 such that adhesive layers 36 and 48 of adhesive anchors 18 and 44 are adhered to each other. This can secure elastic band 16 around article 12 in a loose or snug fit, depending on the loop size and the dimensions of article 12. Additionally, on the opposing side of the formed loop, segments 66 and 68 of elastic band 16 may be folded towards each such that adhesive layers 74 and 76 face each other. This allows a sample item 56 to be suspended from article 12 by adhering adhesive layers 74 and 76 to opposing sides 56*a* and 56*b* of sample item 56, which sides, as shown, may be substantially parallel. As can be appreciated, this arrangement can be used to suspend a variety of different-shaped sample items 56 from article 12.

Although the present disclosure has been described with reference to several embodiments, workers skilled in the art will recognize that changes may be made in form and detail without departing from the spirit and scope of the disclosure.

The invention claimed is:

1. A label assembly including:

a tag portion having opposed first and second ends and including printed indicia thereon;

an elastic band having a bridging segment between opposed first and second ends; and a first adhesive anchor bonded to the second end of the elastic band, wherein the first adhesive anchor includes a first adhesive layer and a first structural support sheet, wherein the first structural support sheet is disposed between the second end of the elastic band and the first adhesive layer, and wherein the first structural support sheet is not adjacent the bridging segment of the elastic band;

wherein:

the first end of the tag portion is not attached to the elastic band; and the second end of the tag portion is bonded to the first end of the elastic band.

2. The label assembly of claim 1, wherein the tag portion includes a first surface and a second opposing surface, wherein the first adhesive anchor is configured to adhere to the tag portion at the second surface.

3. The label assembly of claim 2, wherein the first surface includes the printed indicia.

4. The label assembly of claim 3, further including a polymeric layer disposed on the first surface.

5. The label assembly of claim 2, wherein the second surface includes the printed indicia.

6. The label assembly of claim 1, wherein the first adhesive anchor further includes a first release liner disposed on the first adhesive layer.

7. The label assembly of claim 1, further including a second adhesive anchor by which the second end of the tag portion is bonded to the first end of the elastic band.

8. The label assembly of claim 7, wherein the second adhesive anchor includes a second adhesive layer and a second structural support sheet, wherein the second structural support sheet is disposed between the first end of the elastic band and the second adhesive layer.

9. The label assembly of claim 8, wherein the second structural support sheet includes a sheet material that is non-elastic.

10. The label assembly of claim 8, wherein the second adhesive anchor further includes a second release liner disposed on the second adhesive layer.

11. The label assembly of claim 1, wherein a portion of the first structural support sheet is exposed beyond the second end of the elastic band.

12. A label assembly including:

a tag portion having opposed first and second ends;

an elastic band having a bridging segment between opposed first and second ends; and a first adhesive anchor bonded to the second end of the elastic band, wherein the first adhesive anchor includes:

a first adhesive layer and a first structural support sheet, wherein:

the first structural support sheet is disposed between the second end of the elastic band and the first adhesive layer;

wherein the first structural support sheet is not adjacent the bridging segment of the elastic band; and wherein the first structural support sheet includes a sheet material that is non-elastic.

13. A method of using a label assembly, the method including:

providing the label assembly having:

a tag portion having opposed first and second ends, an elastic band having a bridging segment between opposed first and second ends, and a first adhesive anchor bonded to the second end of the elastic band, wherein the first adhesive anchor includes a first adhesive layer and a first structural support sheet, wherein the first structural support sheet is disposed between the second end of the elastic band and the first adhesive layer, and wherein the first structural support sheet is not adjacent the bridging segment of the elastic band, wherein:

the first end of the tag portion is not attached to the elastic band; and the second end of the tag portion is bonded to the first end of the elastic band;

wrapping the elastic band around a first article; and adhering the adhesive anchor to the tag portion to provide the wrapped elastic band as a loop around the first article.

14. The method of claim 13, wherein the tag portion includes:

a first surface having indicia; and a second surface, wherein adhering the anchor region to the tag portion includes adhering the adhesive anchor to the second surface of the tag portion.

15. The method of claim 14, wherein a size of the loop is based on a placement location of the adhesive anchor along the second surface of the tag portion.

16. The method of claim 13, wherein wrapping the elastic band around the first article further includes bundling the first article with a second article.

17. The method of claim 13, further including removing a first release liner from the first adhesive anchor before adhering the first adhesive anchor to the tag portion.

18. The method of claim 13, wherein providing the label assembly includes adhering the tag portion to the elastic band via a second adhesive anchor.

19. The method of claim 18, further including removing a second release liner from the second adhesive anchor before adhering the second adhesive anchor to the tag portion.

* * * * *